US005620403A

United States Patent [19]

Lundin

[11] Patent Number: 5,620,403

[45] Date of Patent: Apr. 15, 1997

[54] SLIDING EXERCISE MACHINE

[75] Inventor: Christopher B. Lundin, Newark, Del.

[73] Assignee: Physiq, Inc., Mullica Hill, N.J.

[21] Appl. No.: 536,322

[22] Filed: Sep. 29, 1995

[51] Int. Cl.[6] ..... A63B 21/00

[52] U.S. Cl. ..... 482/96; 482/130; 482/908

[58] Field of Search ..... 482/72, 93–96, 482/121, 129, 130, 142

[56] References Cited

U.S. PATENT DOCUMENTS

| | | | |
|---|---|---|---|
| 682,988 | 9/1901 | Hazelip | 482/96 |
| 1,982,872 | 12/1934 | Husted | 482/72 |
| 3,658,327 | 4/1972 | Thiede | 482/96 |
| 3,892,404 | 7/1975 | Martucci | 482/96 |
| 4,004,801 | 1/1977 | Campanaro et al. | 482/96 |
| 4,101,124 | 7/1978 | Mahnke | 482/96 |
| 4,383,684 | 5/1983 | Schliep | 482/96 |
| 4,911,438 | 3/1990 | Van Straaten . | |
| 5,029,848 | 7/1991 | Sleamaker | 482/96 |
| 5,169,363 | 12/1992 | Campanaro et al. . | |
| 5,435,799 | 7/1995 | Lundin | 482/130 |

*Primary Examiner*—Richard J. Apley
*Assistant Examiner*—Victor K. Hwang
*Attorney, Agent, or Firm*—Norman E. Lehrer; Jeffrey S. Ginsberg

[57] ABSTRACT

A sliding exercise machine comprises a main frame that has a housing movably mounted thereto along the vertical plane. A support is secured to and is movable with the housing. A board is slidably mounted atop the support and is slidable along the length of the same through manipulation of handles positioned at opposite ends of a cord. Secured to one end of the support is a bottom cross bar. An intermediate cross bar is positioned between the main frame and the bottom cross bar. A pair of spaced cables are secured between the bottom cross bar and the said main frame and extend through the intermediate cross bar. At least one tension band is removably secured to the bottom cross bar and either the board or the intermediate cross bar.

18 Claims, 4 Drawing Sheets

Fig. 1
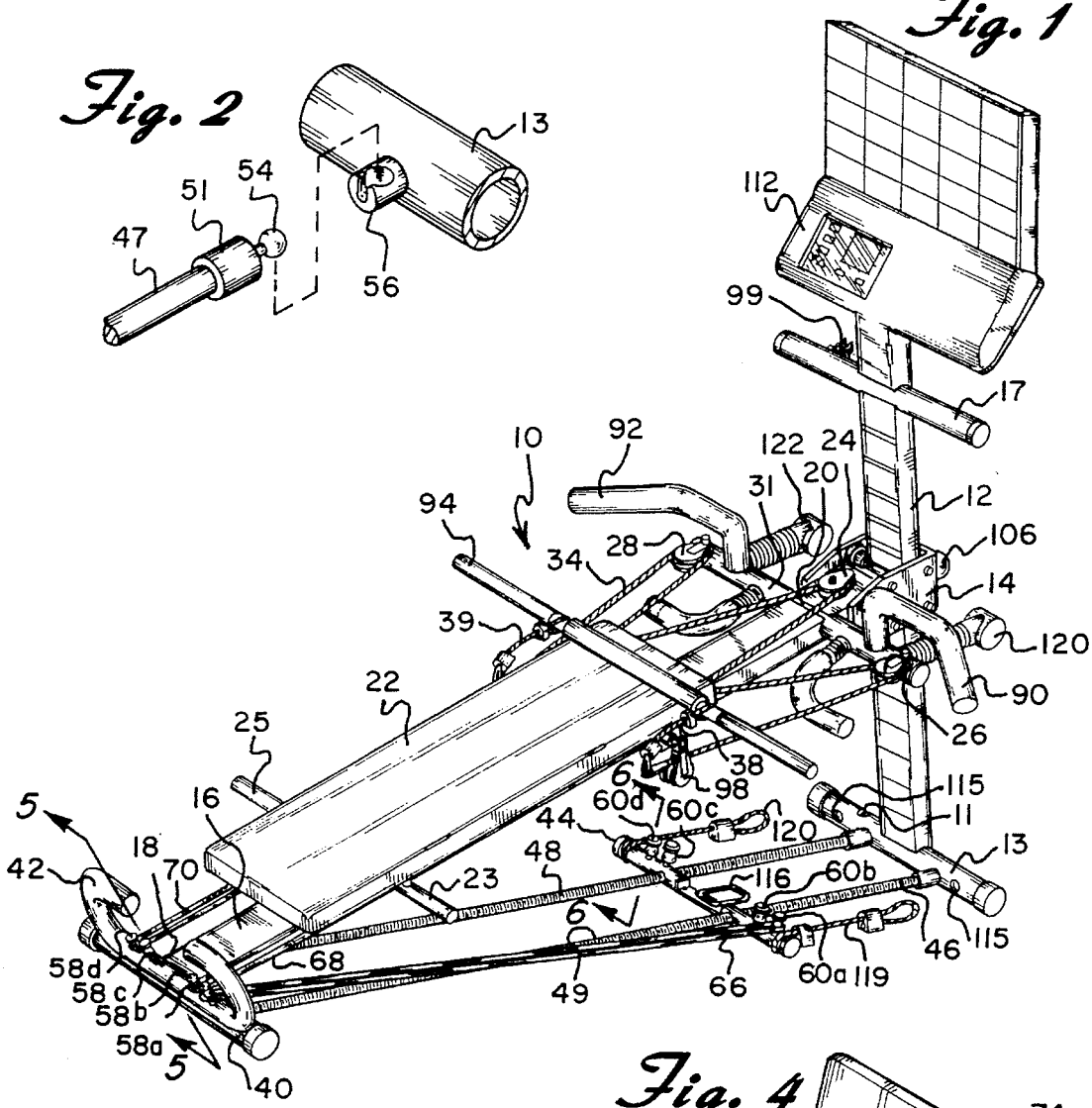
Fig. 2
Fig. 3
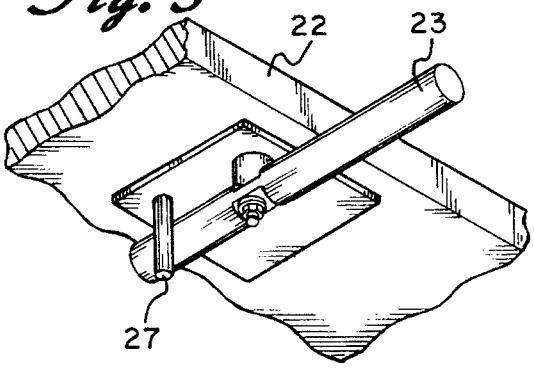
Fig. 4
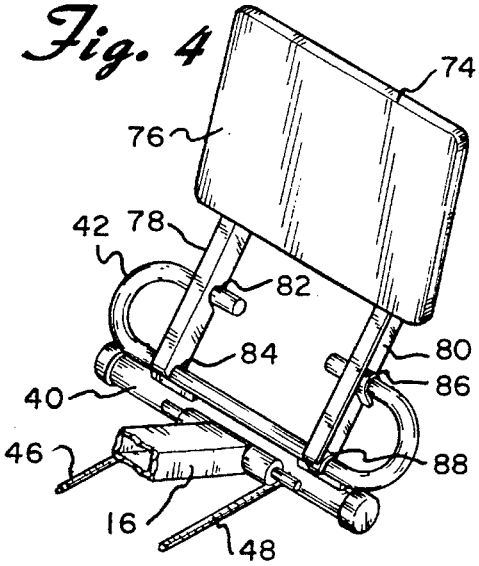

SLIDING EXERCISE MACHINE

BACKGROUND OF THE INVENTION

The present invention is directed toward a sliding exercise machine for providing an aerobic and/or anaerobic workout and, more particularly, to such an exercise machine having a glide board slidably mounted to a support. A person exercises against his or her own weight as well as tension bands that either ride with the board or are secured to the exercise machine in such a manner that they do not increase the force necessary to move the board.

Many people that would like to go to a gym to workout find they do not have the requisite time or money to do so. This has caused an increased demand for home exercise machines. A desirable feature of home exercise machines is the ability to provide a complete workout for both the upper and lower body. It is also desirable to have an exercise machine that can provide an aerobic or anaerobic workout. This is so several different machines do not have to be purchased.

A popular type of home exercise machine is one in which an inclined board is slidably mounted on a support and the user exercises against his or her own weight. See, for example, U.S. Pat. Nos. 4,911,438 and 5,169,363 to Van Straaten and Campanaro et al., respectively.

The Van Straaten patent discloses a slidable exercise machine in which the board moves up and down a rail member through manipulation of handles at opposite ends of a rope attached to a pulley system. This machine is deficient in that it is limited in the exercises a user is capable of performing. For example, this machine is not adapted to allow a user to exercise his or her lower body. Moreover, the pectoral region can not be specifically targeted during a workout.

Another drawback with the exercise machine disclosed in the Van Straaten patent lies in the way the tension bands are secured thereto. More specifically, when two or more bands are utilized, they are secured adjacent one another on one side of the machine in such a manner that the outer bands must be removed from the machine in order to remove the inner bands. This is quite inconvenient.

The exercise machine disclosed in the Campanaro patent is likewise limited in the types of exercises a user can perform. This machine is adapted only to exercise the lower legs for purposes of rehabilitation. In addition, this exercise machine is not foldable for easy and compact storage.

Accordingly, there is a need for a sliding exercise machine that allows the user to perform a variety of different exercises and is readily collapsible so that it can be stored.

SUMMARY OF THE INVENTION

The present invention is designed to overcome the deficiencies of the prior art discussed above. It is an object of this invention to provide a device that can provide both an aerobic and anaerobic workout for a user.

It is a further object of this invention to provide an exercise machine that is adapted to workout the upper as well as the lower body to provide a complete workout.

It is yet another object of the invention to provide such a device that can be conveniently stored when not in use.

It is still another object to provide an exercise machine wherein the force necessary to move the board can be readily changed.

In accordance with the illustrative embodiments, demonstrating features and advantages of the present invention, there is provided a sliding exercise machine comprising a main frame and a housing movably mounted to the frame along a vertical plane. A support is secured to and is movable with the housing. A glide board is mounted atop the support and is slidable along the length of the same through manipulation of handles positioned at opposite ends of a cord. A bottom cross bar is secured to one end of the support. An intermediate cross bar is positioned between the main frame and the bottom cross bar. At least one tension band is removably secured to the bottom cross bar and either the board or the intermediate cross bar.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 1 is a perspective view of an exercise machine constructed in accordance with the present invention;

FIG. 2 is a partial cross-sectional view of the end of a cable shown detached from the transverse base member of the exercise machine;

FIG. 3 is a perspective view of the underside of the board showing an attached hand grip;

FIG. 4 is a perspective view of the leg attachment;

DETAILED DESCRIPTION OF THE PREFERRED EMBODIMENT

Figure 5:
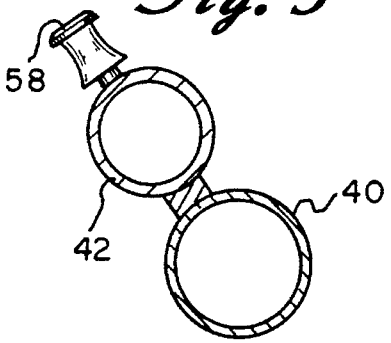
FIG. 5 is a cross-sectional view taken along lines 5—5 of FIG. 1.
Figure 6:
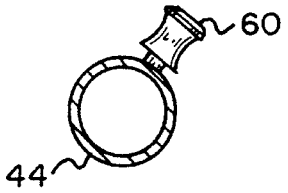
FIG. 6 is a cross-sectional view taken along lines 6—6 of FIG. 1.

Referring now to the drawings in detail wherein like reference numerals have been used throughout the various figures to designate like elements, there is shown in FIG. 1 a sliding exercise machine constructed in accordance with the principles of the present invention and designated generally as 10.

The sliding exercise machine 10 includes a main frame 12. The main frame has a transverse base member 13 secured to the bottom thereof. In the preferred embodiment, an upper cross bar member 17 is positioned adjacent the top of the main frame. A housing 14 is movably mounted to the frame 12 along a vertical plane. A support 16 having first and second ends, 18 and 20 respectively, is secured to and movable with the housing 14. A glide board 22 is slidably mounted atop the support 16.

A pair of hand grips 23 and 25 are pivotally secured to the underside of glide board 22. The hand grips 23 and 25 are substantially identical to one another. Accordingly, only one of the hand grips will be described in detail, it being understood that the description applies equally to the other hand grip. Referring to FIG. 3, the hand grip 23 perpendicularly extends from the right side of board 22 when in use. Stop guide 27 prevents further rotation of the hand grip once it perpendicularly extends from the board 22. When the hand grip 23 is not in use, the hand grip is rotated counter clockwise so it does not project from the side of the board 22.

Figure 16:
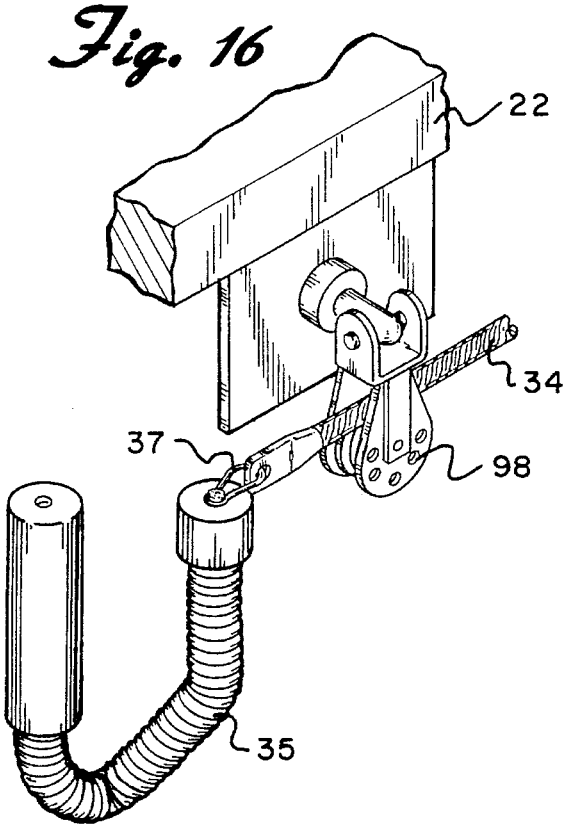
FIG. 16 is a side perspective view of one of the handles.
Figure 14:
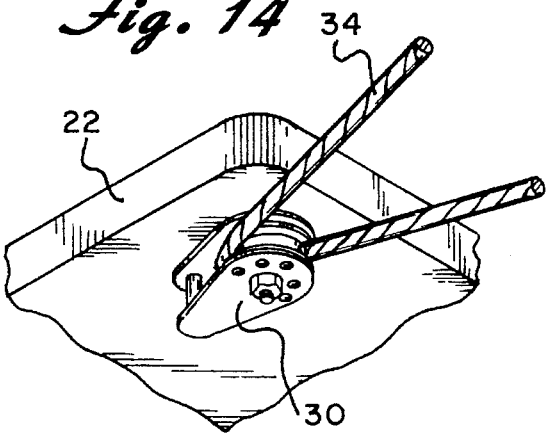
FIG. 14 is a partial perspective view of the bottom of the board.

Referring back to FIG. 1, a central pulley 24 is positioned atop the housing 14. A pair of spaced apart secondary pulleys 26 and 28, respectively, are secured to a top cross bar 31. A right guide pulley 30 is secured beneath the right side of the board 22 as shown in FIG. 14. A left guide pulley (not shown) is similarly secured to beneath the left side of the board. A cord 34 is positioned around the central pulley 24. Each end of the cord 34 is positioned around a corresponding guide pulley and around a corresponding secondary pulley 26 and 28. A clip 37 is adapted to secure a right handle 35 to one of the cord 34 as illustrated in FIG. 16. Similarly, a left handle can be secured to the other end of cord 34. Manipulation of the handles moves the board 22 along the support.

A bottom cross bar 40 is secured to the first end 18 of the support 16. In the preferred embodiment, a C-shaped support bar 42 is secured atop the bottom cross bar 40. An intermediate cross bar 44 is positioned between the transverse base member 13 and the bottom cross bar 40. A pair of spaced apart support cables 46 and 48 are secured between the bottom cross bar 40 and the transverse base member 13 of the main frame 12. The cables 46 and 48 extend through the intermediate cross bar 44.

The support cables 46 and 48 are substantially identical to one another. Accordingly, only one of the cables will be described in detail, it being understood that the description applies equally to the other cable. The cable 46 includes an inner segment 47 surrounded by a coiled covering 49 (see FIGS. 1 and 2). A ball type head 54 extends from the end of the inner segment 47 closest to the transverse base member 13 as shown in FIG. 2. A collar 51 is secured to one end of the coiled covering 49 and is adapted to extend past the ball type head 54. When the sliding exercise machine is in its operating position, the ball type head 54 is inserted into a key hole extension 56 which projects from transverse base member 13. This is accomplished by pushing collar 51 so that the attached coiled covering is compressed and the ball type head 54 is exposed as shown in FIG. 2. The ball type head is then placed in extension 56. The collar is then released and the elastic restoring force of the coiled covering 49 causes the collar to surround the ball type head 54 and the key hole extension 56.

Figure 15:
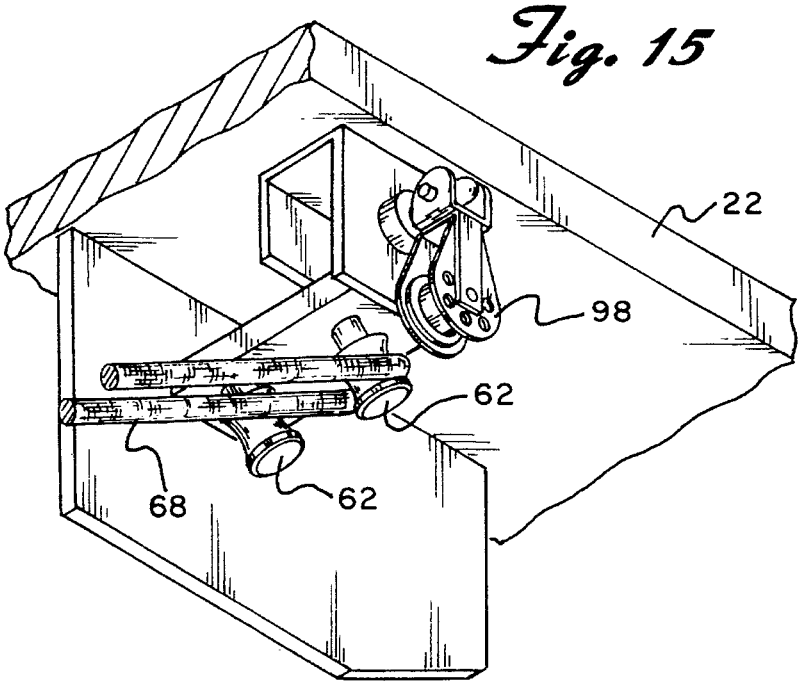
FIG. 15 is a partial perspective view of the bottom of the board showing a tension band secured thereto.

In the preferred embodiment, the C-shaped support bar 42 has a number of raised projections 58*a–d* extending therefrom. Similarly, a number of raised projections 60*a–d* extend from the intermediate cross member 44. Glide board projections 62 extend from the board adjacent the end furthest from the bottom cross bar 40 (see FIG. 15). A number of tension bands 66, 68 and 70 are each secured around one of the projections 58*a–d* and a corresponding glide board projection 62 in order to increase the amount of force necessary to slide the board 22 along the support 16. It should be noted that while only three tension bands are shown, the total number of bands that ride with the board can be increased or decreased in order to correspondingly increase or decrease the resistance of the machine.

In order to reduce the amount of force required to move the gliding board 22, the tension bands are positioned around projections 58 on bottom cross bar 40 and projections 60 on intermediate cross bar 44. When so positioned, the tension bands do not ride with the board 22 during the exercise.

In the preferred embodiment, the sliding exercise machine 10 includes a leg attachment 74. Leg attachment 74 includes a foot platform 76 and a pair of spaced apart connecting rods 78 and 80 (see FIG. 4). The connecting rods 78 and 80 are substantially identical to each other. Accordingly, only one of the rods will be described in detail, it being understood that the description applies equally to the other connecting rod. The connecting rod 78 has a pair of U-shaped slots 82 and 84 formed therein. U-shaped slot 84 is formed to securely fit around the elongated section of C-shaped support bar 42 and U-shaped slot 82 is formed to securely fit around the leg of C-shaped bar as illustrated in FIG. 4. U-shaped slots 86 and 88 are secured to C-shaped bar 42 in a similar manner.

Figure 7:
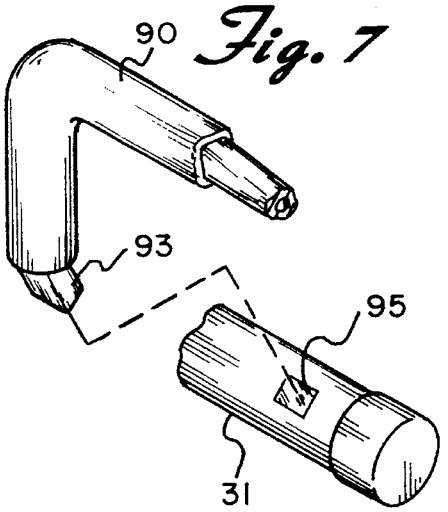
FIG. 7 is a partial perspective view of the pull up bar.

Referring to FIGS. 1 and 7, the exercise machine 10 includes a pair of curved pull up bars 90 and 92. Again, while only one pull up bar will be described in detail, it should be understood that the description equally applies to the other pull up bar. The pull bar 90 preferably has a square portion 93 projecting from one end as illustrated in FIG. 7. The square portion 93 is fitted into square hole 95 formed in top cross bar 31 so that the pull up bar is secured in place. The pull up bar is rotated 90° when the exercise machine is placed in the storage position in the manner described below.

The exercise machine 10 includes a bench press bar 94 for allowing the user to concentrate on working out his pectoral muscles as shown in FIG. 1. In use, the ends of cord 34 are secured around side pulleys 98 which extend from opposite sides of the glide board 22. Straps 38 and 39 secure the ends of the cord 34 to the bench press bar 94. When the bench press bar is not being used, the straps 38 and 39 are removed from the ends of the cord and one end of the bar is placed in hole 11 formed in transverse cross bar 13. The other end of the bar is secured to the upper cross bar member 17 by means of a clip 99.

Figure 12:
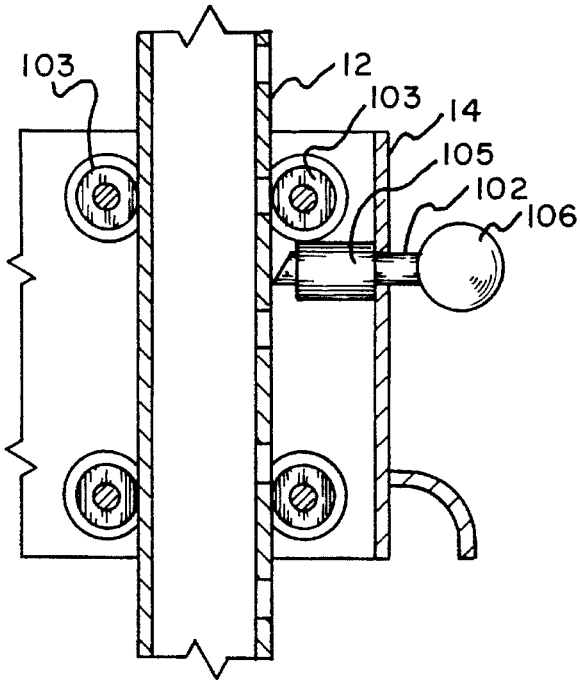
FIG. 12 is a cross-sectional view of the housing.
Figure 13:
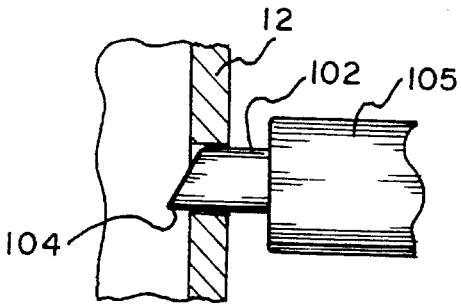
FIG. 13 is cross-sectional view of the locking pin engaged in the housing.

As stated above, the housing 14 is movably mounted to the frame 12 so that it can move along the vertical plane. The housing 14 moves along main frame 12 by means of rollers 103 as shown in FIG. 12. The main frame 12 has a plurality of holes 15 formed along the vertical plane. Locking pin 102 is inserted through housing 14 and into one of a plurality of holes 15 formed in main frame 12 to secure the housing to the frame. The locking pin 102 has a tapered tip 104 (see FIG. 13). The tapered tip 104 facilitates the entry of locking pin 102 into one the holes 15 in main frame 12. The locking pin 102 is spring biased in pin support 105 which is secured in housing 14. Accordingly, when knob 106 is pulled, the pin tip 104 is moved out of hole 15 and the housing is free to move up and down the main frame 12 which in turn raises or lowers the level of inclination of the attached board 22. Once a predetermined level of inclination is achieved, the knob 106 is released and the tension restoring force from the spring (not shown) causes the tip 104 of pin 102 to enter a hole 15 aligned along the same horizontal plane.

In the preferred embodiment, an adjustable display means 112 is mounted atop the main frame 12 (see FIG. 1). The display means 112 is equipped with a computer to provide the user with a variety of information such as the user's heart rate, how many calories are being burned and how much time is remaining to complete the workout.

To facilitate an understanding of the principles associated with the foregoing apparatus, its operation will now be briefly described. Before using the sliding exercise machine 10, the user pulls knob 106 to move the tip 104 of locking pin 102 out of hole 15 in main frame 12 so that the housing is free to move along the length of main frame 12. This allows the angle of inclination of the attached board 22 to be set at a desired angle. The machine user then has to decide what type of exercise he or she wants to perform. For example, exercise involving the pulleys can be performed by the user grasping each of the handles 35 and 36 and pulling the same. This causes the board to move along the support 16.

On the other hand several other types of exercises can be performed. For example, to perform a bench press exercise, the ends of bench press bar 94 are inserted through straps 38 and 39. The exerciser lays prostrate on the board 22 and grasps the ends of the bench press bar. To perform the bench press exercise, the user's arms are fully extended and then contracted. This is repeated until a desired number of repetitions have been reached.

A pull up type exercise can be performed by the user lying on his stomach and grasping pull up bars 90 and 92. As the user pulls on the bars 90 and 92, the board slides up the support 16. The user then pushes on the bars to cause the board to slide down the support.

Regardless of the exercise performed, the level of difficulty can be increased by securing tension bands 66, 68 and 70 to the board. This is accomplished by securing one or more tension bands around a corresponding glide board projection 62. Additionally, the level of difficulty can be increased by increasing the angle of inclination of the board by pulling locking pin 102 from hole 15 in main frame 12 and moving the housing 14 upward. The tip 104 of pin 102 is then re-inserted into a hole 15 to lock the housing and attached board 22 in place.

Figure 8:
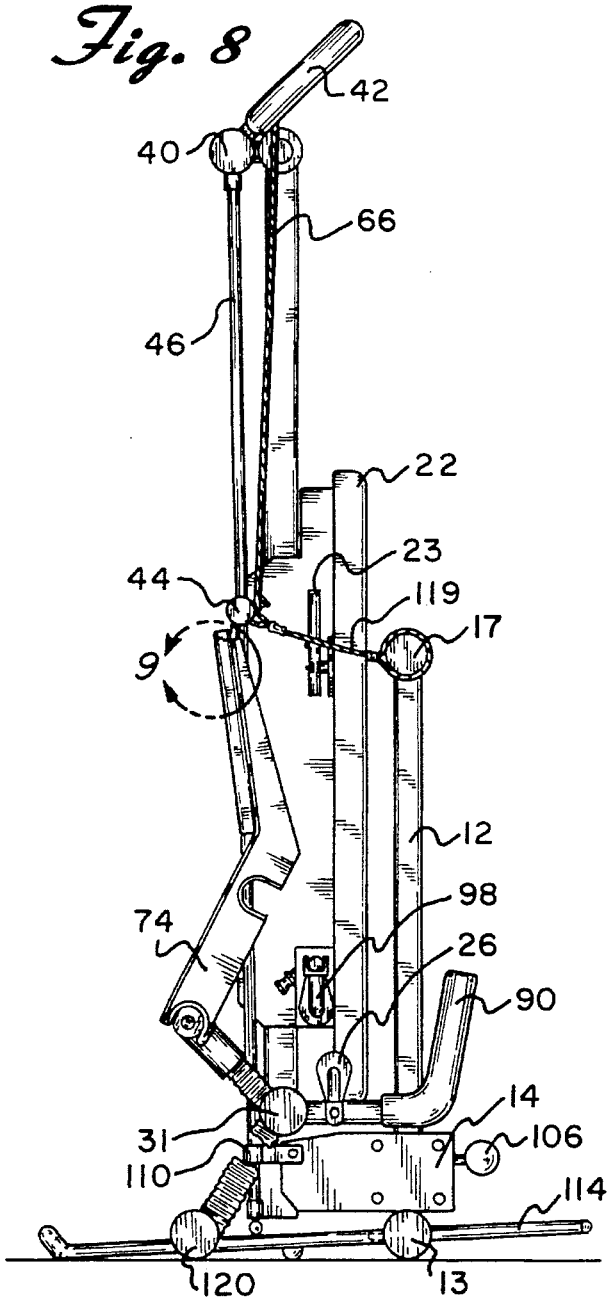
FIG. 8 is a side view of the exercise machine in the folded position.

After an exercise session is completed, the sliding exercise machine can be folded up and stored away. This is accomplished by removing ball type head 54 from key hole projection 56 so that the cables 46 and 48 are detached from transverse cross member 13. The end of cable 46 is secured in a cable bracket 110 secured to the right side of side of housing 14 as shown in FIG. 8. The end of cable 48 is similarly secured in a cable bracket (not shown) located on the left side of housing 14. Pull up bars 90 and 92 are removed from square holes 95 in top cross bar 31 and rotated 90° so they do not extend past the cross bar. The bench press bar is placed in hole 11 in transverse cross member 13. Hand grips 23 and 25 are also rotated 90° so they no longer extend from the sides of glide board 22. The leg attachment 76 is removed from C-shaped support bar 41. Next, knob 106 is manually pulled so that the tip 104 of the pin 102 is removed from hole 15 in main frame 12. The housing 14 is then folded downward until its bottom rests on the transverse base member 13.

Figure 10:
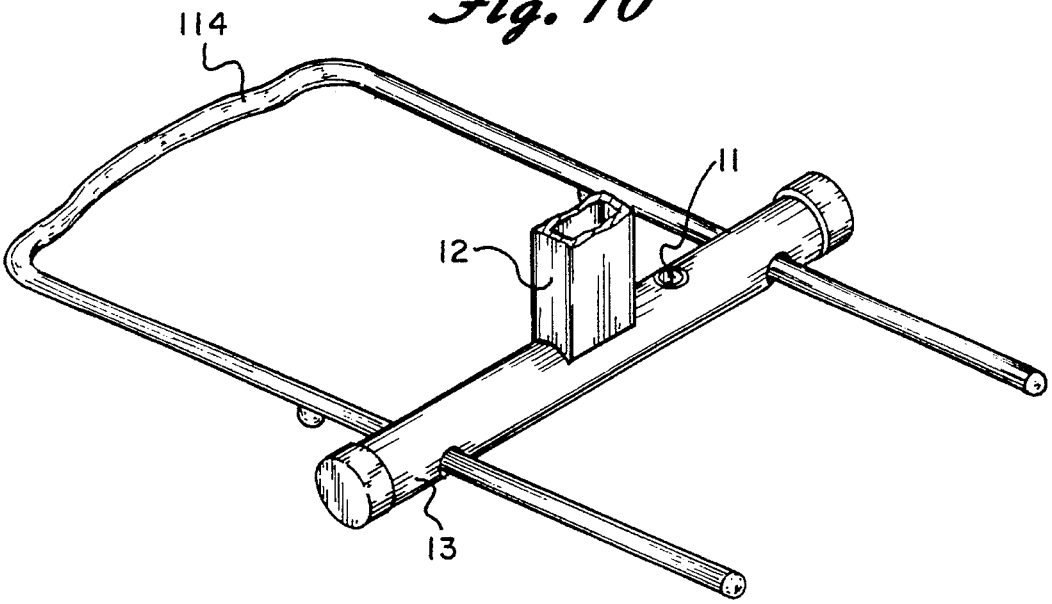
FIG. 10 is a perspective view of the U-shaped stand.
Figure 11:
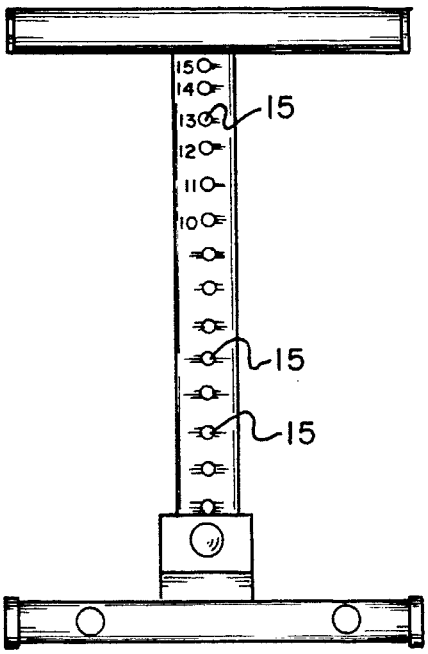
FIG. 11 is a rear view of the main frame and the housing.

In the preferred embodiment, a U-shaped stand 114 is secured in base member 13 through holes 115 formed therein when the sliding exercise machine is placed in its folded position (see FIG. 10). This allows the machine to be upended so that it stands on U-shaped stand 114 as shown in FIG. 8. A pair of storage wheels 120 and 122 secured to the top cross bar 31 facilitates the transportation of the exercise machine 10 when it is in its folded position.

Figure 9:
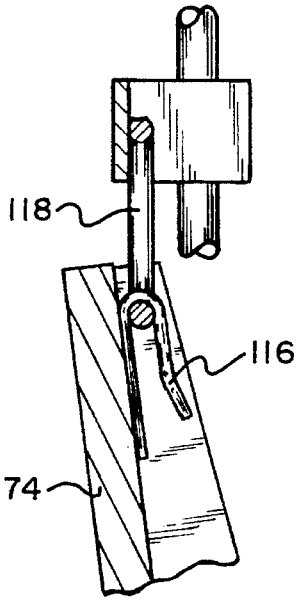
FIG. 9 is a partial cross-sectional view taken along lines 9—9 of FIG. 8.

Referring to FIG. 9, a clip 116 is preferably secured to the back of leg attachment 74 and a square support 118 is attached to intermediate cross bar 44. When the sliding exercise machine is placed in its folded condition, the clip 116 is friction fitted around the square support 118 (see FIG. 9).

Strap cords 119 and 120 are secured around intermediate cross member 44 and upper cross bar member 17 to hold the exercise machine 10 in the folded condition (see FIGS. 1 and 8).

The present invention may be embodied in other specific forms without departing from the spirit or essential attributes thereof and accordingly reference should be made to the appended claims rather than to the foregoing specification as indicating the scope of the invention.

What is claimed is:

1. A sliding exercise machine comprising:

a main frame;

a housing movably mounted to said main frame along a vertical plane;

a support having first and second ends, said second end of said support being secured to and movable with said housing;

a board slidably mounted atop said support, said board being slidable along the length of said support;

a pulley means comprising a first pulley means carried by said housing and second pulley means carried by said board;

a cord having opposing ends and being positioned around each of said pulley means so that manipulation of said cord moves said board along said support;

handle means extending from said opposing ends of said cord;

an intermediate cross bar positioned between said first end of said support and said main frame, and cable means secured between said first end of said support and said main frame, said cable means extending through said intermediate cross bar;

tension means, and first projecting means for removably securing said tension means to said first end of said support and said board.

2. The exercise machine of claim 1 further including second projecting means for removably securing said tension means to said first end of said support and said intermediate cross bar.

3. The exercise machine of claim 2 wherein said tension means includes at least one tension band.

4. The exercise machine of claim 2 further including third pulley means, said first pulley means including a central pulley carried by said housing, said second pulley means including a pair of guide pulleys carried by said board, said third pulley means including a pair of spaced apart pulleys carried by opposing sides of said support adjacent said second end, said cord positioned around said central pulley, then around each of said corresponding guide pulleys and then around each of said spaced apart pulley.

5. The exercise machine of claim 4 wherein said pulley means further includes a pair of side pulleys secured to opposite sides of said board, said cord positioned around each of said side pulleys.

6. A sliding exercise machine comprising:

a main frame;

a housing movably mounted to said frame along a vertical plane;

a support having first and second ends, said second end of said support being secured to and movable with said housing;

a board slidably mounted atop said support, said board being slidable along the length of said support;

a pulley means comprising a first pulley means carried by said housing and second pulley means carried by said board;

a cord having opposing ends and being positioned around each of said pulley means so that manipulation of said cord moves said board along said support;

handle means secured to said opposing ends of said cord;

a bottom cross bar secured to said first end of said support;

an intermediate cross bar positioned between said main frame and said bottom cross bar;

cable means secured between said bottom cross bar and said main frame and extending through said intermediate cross bar;

a tension band, and first projecting means for removably securing said tension band to said bottom cross bar and said board.

7. The exercise machine of claim 6 further including means for adjusting the angle of inclination of said board.

8. The exercise machine of claim 7 wherein said adjusting means includes said main frame having a plurality of holes aligned along the same vertical plane and a locking pin, said locking pin being inserted through said housing and into one of said plurality of holes.

9. The exercise machine of claim 8 wherein said locking pin has a tapered tip to facilitate entry of said locking pin in one of said holes in said main frame.

10. The exercise machine of claim 6 further including second projecting means for removably securing said tension band to said bottom cross bar and said intermediate cross bar.

11. The exercise machine of claim 10 further including a top cross bar secured between said housing and said second end of said support.

12. The exercise machine of claim 11 further including third pulley means, said first pulley means including a central pulley carried by said housing, said second pulley means including a pair of guide pulleys carried by said board, said third pulley means including a pair of spaced apart pulleys carried by said top cross bar, said cord positioned around said central pulley, then around each of said guide pulleys and then around each of said spaced apart pulleys.

13. The exercise machine of claim 12 wherein said pulley means further includes a pair of side pulleys secured to opposite sides of said board, said cord positioned around each of said side pulleys.

14. The exercise machine of claim 13 wherein said handle means includes a pair of handles secured to opposing ends of said cord.

15. The exercise machine of claim 14 further including a bench press bar positioned above said board, each of the opposing ends of said cord being removably secured to an opposing end of said bench press bar.

16. The exercise machine of claim 13 further including a pair of spaced apart pull up bars extending from and being mounted for rotation in said top cross bar.

17. The exercise machine of claim 16 further including a pair of hand grips secured to opposite sides of said board.

18. The exercise machine of claim 6 further including a C-shaped support bar secured atop said bottom cross bar, a leg attachment, and means for removably engaging said leg attachment to said C-shaped support bar.

* * * * *